US006968640B2

(12) United States Patent
Lee

(10) Patent No.: US 6,968,640 B2
(45) Date of Patent: Nov. 29, 2005

(54) HALF MIRROR REFLECTOR HAVING LED ROAD SIGN

(76) Inventor: Kil Suo Lee, #70-1 Samsong-ri, Yangjoo-eup, Yangjoo-kun, Kyeonggi-do (KR)

( * ) Notice: Subject to any disclaimer, the term of this patent is extended or adjusted under 35 U.S.C. 154(b) by 231 days.

(21) Appl. No.: 10/674,273

(22) Filed: Sep. 29, 2003

(65) Prior Publication Data

US 2004/0223223 A1 Nov. 11, 2004

(51) Int. Cl.[7] ..... G09F 13/00

(52) U.S. Cl. ..... 40/541; 40/550; 40/553; 40/607.14; 359/871; 359/839; 359/868

(58) Field of Search ..... 40/541, 550, 553, 40/607.01, 607.12, 612, 607.14, 900; 359/871, 359/839, 868

(56) References Cited

U.S. PATENT DOCUMENTS 4,253,415 A * 3/1981 Ferch ..... 116/63 P
4,978,207 A * 12/1990 Gillner et al. ..... 359/871
5,023,607 A * 6/1991 Staten ..... 340/908.1
5,589,984 A * 12/1996 Schmidt et al. ..... 359/603
5,819,455 A * 10/1998 Tsuda ..... 40/580
5,863,109 A * 1/1999 Hsieh ..... 362/245
5,974,712 A * 11/1999 Kallionpaa ..... 40/612
6,092,318 A * 7/2000 Arie et al. ..... 40/547
6,264,334 B1 * 7/2001 Kushida ..... 359/515
6,762,689 B2 * 7/2004 Dechape ..... 340/815.45

* cited by examiner

*Primary Examiner*—Gary C. Hoge
(74) *Attorney, Agent, or Firm*—Sofer & Haroun, LLP

(57) ABSTRACT

Disclosed is a half mirror reflector having an LED road sign, which can be used as a reflector in the daytime and as both a reflector and a road sign in the nighttime. The half mirror reflector comprises: a support plate attached to a support rod; a half mirror fixed to the support plate; an LED road sign mounted on the support plate under the half mirror and having a plurality of LEDs; a PCB substrate mounted on the support plate under the half mirror to control the operation of the LED road sign; and a solar battery module provided at the upper part of the support rod to generate a voltage for operating the LED road sign and supply the voltage to the PCB substrate.

15 Claims, 7 Drawing Sheets

HALF MIRROR REFLECTOR HAVING LED ROAD SIGN

RELATED APPLICATION

This application is related to and claims the benefit of priority to Korean Patent Application No. 2003-0029444, filed May 9, 2003, the entirety of which is incorporated herein by reference.

BACKGROUND OF THE INVENTION

1. Field of the Invention

The present invention relates to a half mirror reflector having an LED road sign, and more particularly to a half mirror reflector having an LED road sign, which can be used as a reflector in the daytime and as both a reflector and a road sign in the nighttime.

2. Description of the Prior Art

Cars have become a complex necessity of modern life. As the number of cars on the roads is rapidly increasing, most countries try to expand infrastructures and build more roads to solve road traffic problems. However, countries having small land areas and relatively high population densities, such as Korea, have poor road conditions compared to the growing number of cars. Such countries have difficulties in securing enough money and available land area to build more roads, including highways, to keep up with the growing number of cars.

The increase in cars causes problems on roads and causes traffic accidents. In poor road conditions and particularly on winding or curved roads, it is critical for drivers to rapidly perceive the condition of the road invisible beyond sharp curves.

Therefore, circular half mirror reflectors are generally installed at the corners of curved roads to enable drivers to see the condition of forthcoming road beforehand. The circular half mirror reflectors help drivers not only to check ahead the road condition of the direction to which they will turn, but also to show their presence to the vehicles approaching in the opposite direction, thereby preventing possible traffic accidents.

FIG. 1 is a perspective view of a conventional stainless road reflector.

Referring to FIG. 1, a conventional stainless road reflector comprises a convex mirror 3 fixed to a support plate 2, a hood 4 attached to the upper part of the support plate 2, a fixing bracket 5 for fixing the support plate 2 to a support rod 1 by a bolt/nut assembly 6, and a cap 7 for covering the top of the support rod 1.

The mirror 3 is formed from a metal having high reflectivity (for example, stainless steel). The mirror 3 is machined precisely to have a convex surface that bulges outward at the center thereof.

Since the mirror 3 is made of stainless steel, the conventional stainless road reflector is very weak against stones or other external shocks. Also, the stainless mirror 3 is easily scratched or discolored due to its inferior durability and therefore has a short life.

The conventional stainless road reflector may fail to perform its required function because it is easily crushed or scratched by external shocks and gets discolored with time.

In addition, the conventional stainless road reflector cannot ensure sufficient reflection of an object to enable drivers to check the condition of road ahead in the dark or at night.

SUMMARY OF THE INVENTION

Accordingly, the present invention has been made to solve the above-mentioned problems occurring in the prior art, and one object of the present invention is to provide a half mirror reflector having an LED road sign, which can be used as a reflector in the daytime and as both a reflector and a road sign in the nighttime.

Another object of the present invention is to provide a half mirror reflector having an LED road sign, which can be used as both a reflector and a road sign in a place which is dark even during daytime (for example, in an underground parking lot) by turning on a switch provided on the reflector to supply a DC power to the LED road sign.

Still another object of the present invention is to provide a half mirror reflector having an LED road sign, which is made of polycarbonate (PC) or acryl to improve object reflectivity and endurance to withstand external shocks and to prevent its surface from easily being discolored.

Still another object of the present invention is to provide a half mirror reflector having an LED road sign and operating by means of a solar battery.

Still another object of the present invention is to provide a half mirror reflector having an LED road sign, which converts a current generated by a solar battery to a constant current using a current transformer and supplies the constant current to the LEDs in the LED road sign, thereby ensuring semipermanent use of the LEDs.

In order to accomplish the above objects, there is provided a half mirror reflector comprising: a support plate attached to a support rod; a half mirror fixed to the support plate; an LED road sign mounted on the support plate under the half mirror and having a plurality of LEDS; a PCB substrate mounted on the support plate under the half mirror to control the operation of the LED road sign; and a solar battery module provided at the upper part of the support rod to generate a voltage for operating the LED road sign and supply the voltage to the PCB substrate.

The half mirror reflector further comprises a storage battery mounted on the support plate under the half mirror to store a voltage supplied from the solar battery module and transfer the stored voltage to the PCB substrate.

The half mirror has a convex circular or quadrangular shape.

After forming an aluminum thin film on one side of the half mirror, a transparent coating is applied on both sides of the half mirror.

The half mirror contains a UV protector.

The half mirror is formed from polycarbonate (PC) or acryl.

The half mirror reflector having an LED road sign further comprises: a support bracket fixed to the rear of the support plate; a first bracket fixed to the support bracket; and a second bracket having one end fixed to the first bracket and the other end fixed to the support rod.

The half mirror reflector having an LED road sign further comprises a third bracket for fixing the solar battery module to the upper part of the support rod.

The PCB substrate includes: a first diode for rectifying a direct current generated from the solar battery module and outputting the rectified direct current to a first node; a storage battery for storing a voltage of the first node; a photosensor coupled between the first node and a ground voltage to sense ambient light; a switch box for receiving power from the first node, generating a control signal for operating LEDs in the LED road sign using the photosensor or a switch and outputting the control signal to a third node;

a first transistor for switching the voltage of the first node by a voltage of the third node; a current transformer for converting a first current supplied from the first node through first and second inductors by the switched voltage from the first transistor and generating a second current to be outputted to a third inductor; a second transistor for switching a current to flow through the first and second inductors by the switched voltage from the first transistor; and a second diode for rectifying a current outputted from the current transformer and supplying the rectified current to a plurality of LEDs in the LED road sign.

The PCB substrate further includes: a first resistor coupled between the photosensor and a ground voltage; a second resistor coupled between an output terminal of the switch box and the third node; a third resistor coupled between the third node and a ground voltage; a fourth resistor coupled between one end terminal of the first transistor and a ground voltage; and a fifth resistor coupled between one end terminal of the first transistor and one end terminal of the second inductor.

The first transistor is a PNP bipolar transistor, while the second transistor is an NPN bipolar transistor.

The PCB substrate includes: a bridge diode for converting an AC power into a DC power and outputting the DC power; a plurality of LEDs and a FET switching element connected in series between an output terminal of the bridge diode and a ground voltage; a switching pulse generating IC for receiving the DC power outputted from the bridge diode and generating a switching pulse signal; and an eleventh transistor for driving the FET switching element according to the switching pulse signal.

The PCB substrate further includes: a protective resistor coupled between an output terminal of the bridge diode and an input terminal of the switching pulse generating IC; and a zener diode for maintaining a constant DC voltage to be inputted to the switching pulse generating IC.

The switching pulse generating IC includes a frequency generator for generating a frequency according to an RC time constant and a pulse width controller for controlling a pulse width of a switching pulse.

The eleventh transistor is an NPN bipolar transistor.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
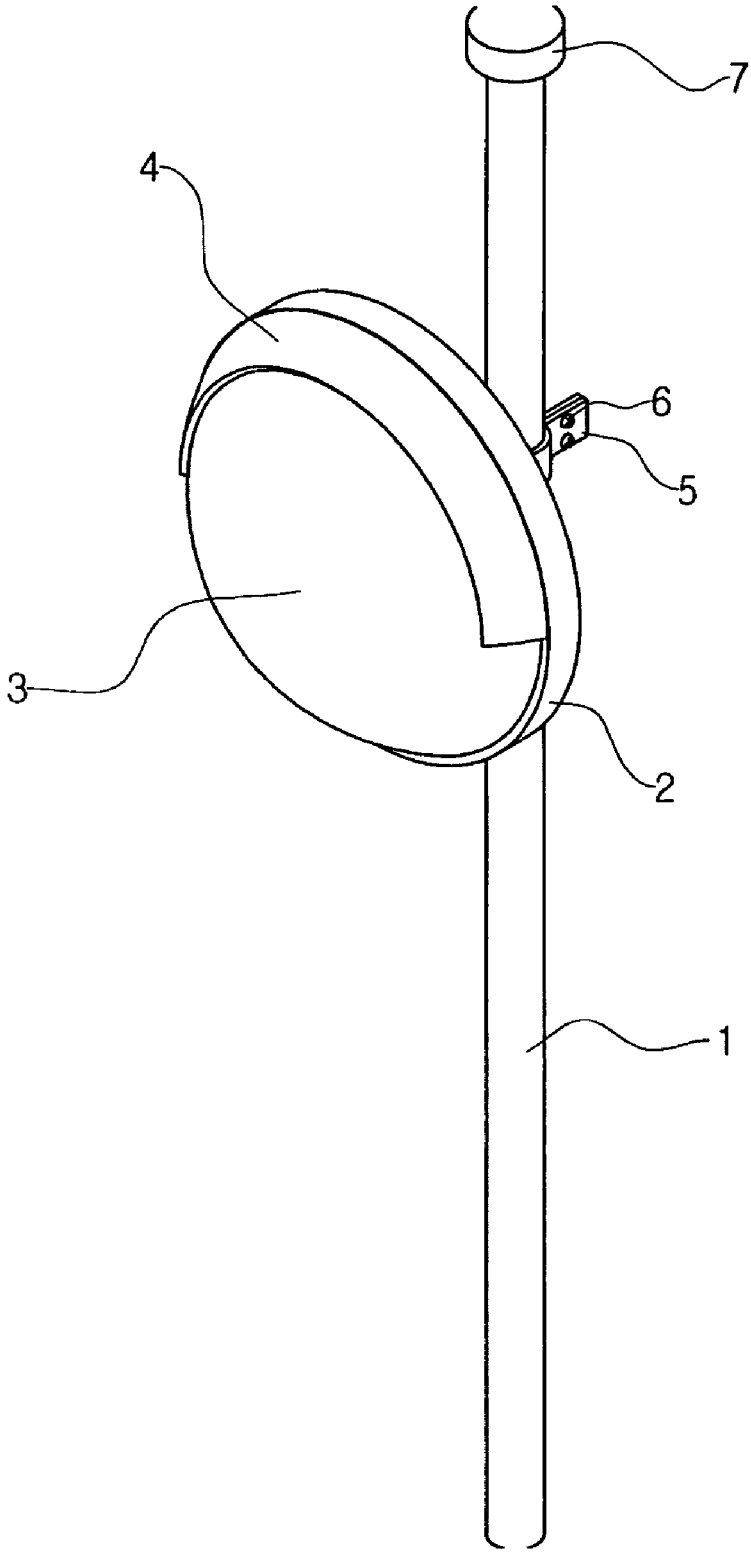
FIG. 1 PRIOR ART
FIG. 1 is a perspective view of a stainless road reflector of the prior art.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2:
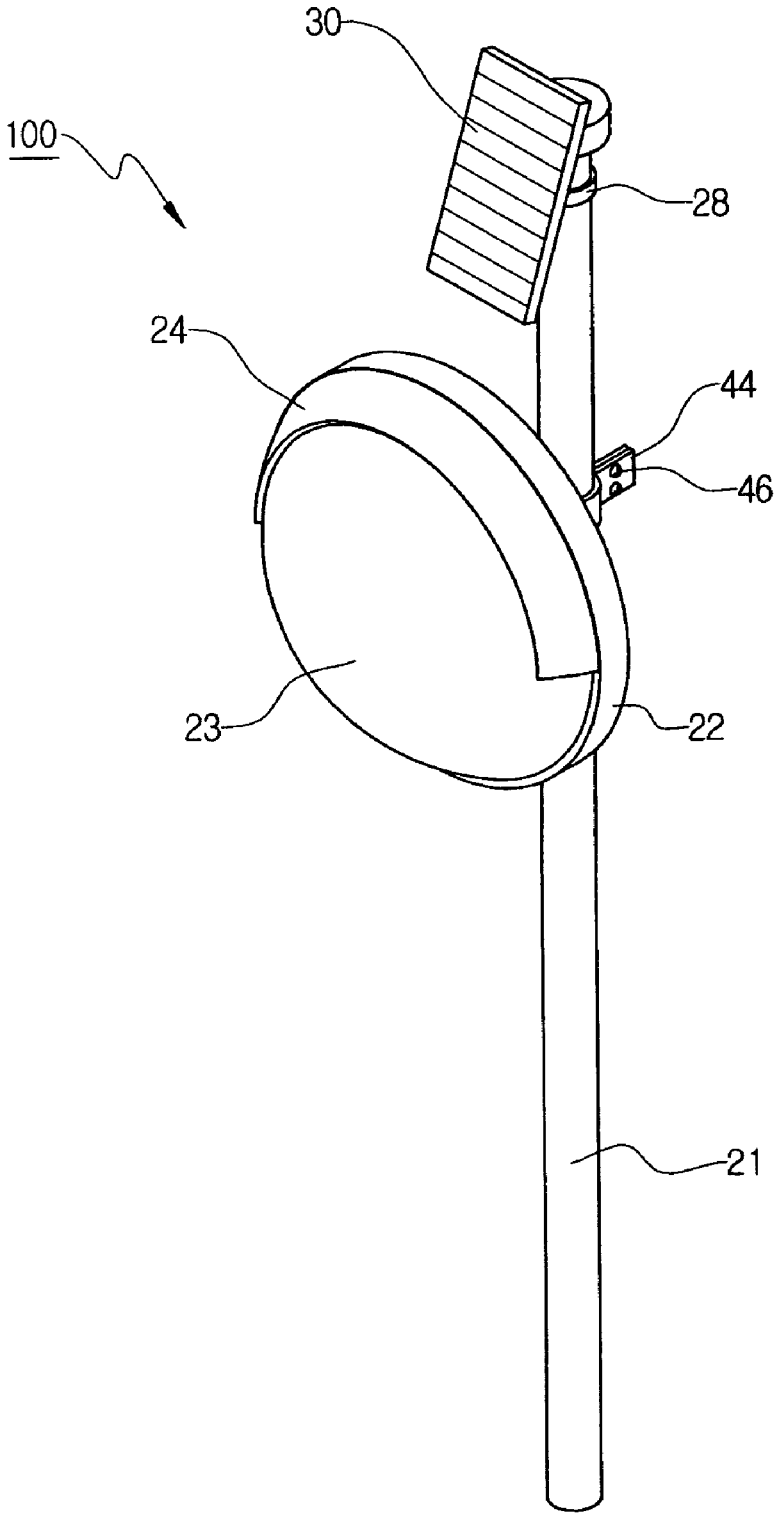
FIG. 2 is a perspective view of a half mirror reflector having an LED road sign according to the present invention.
Figure 3:
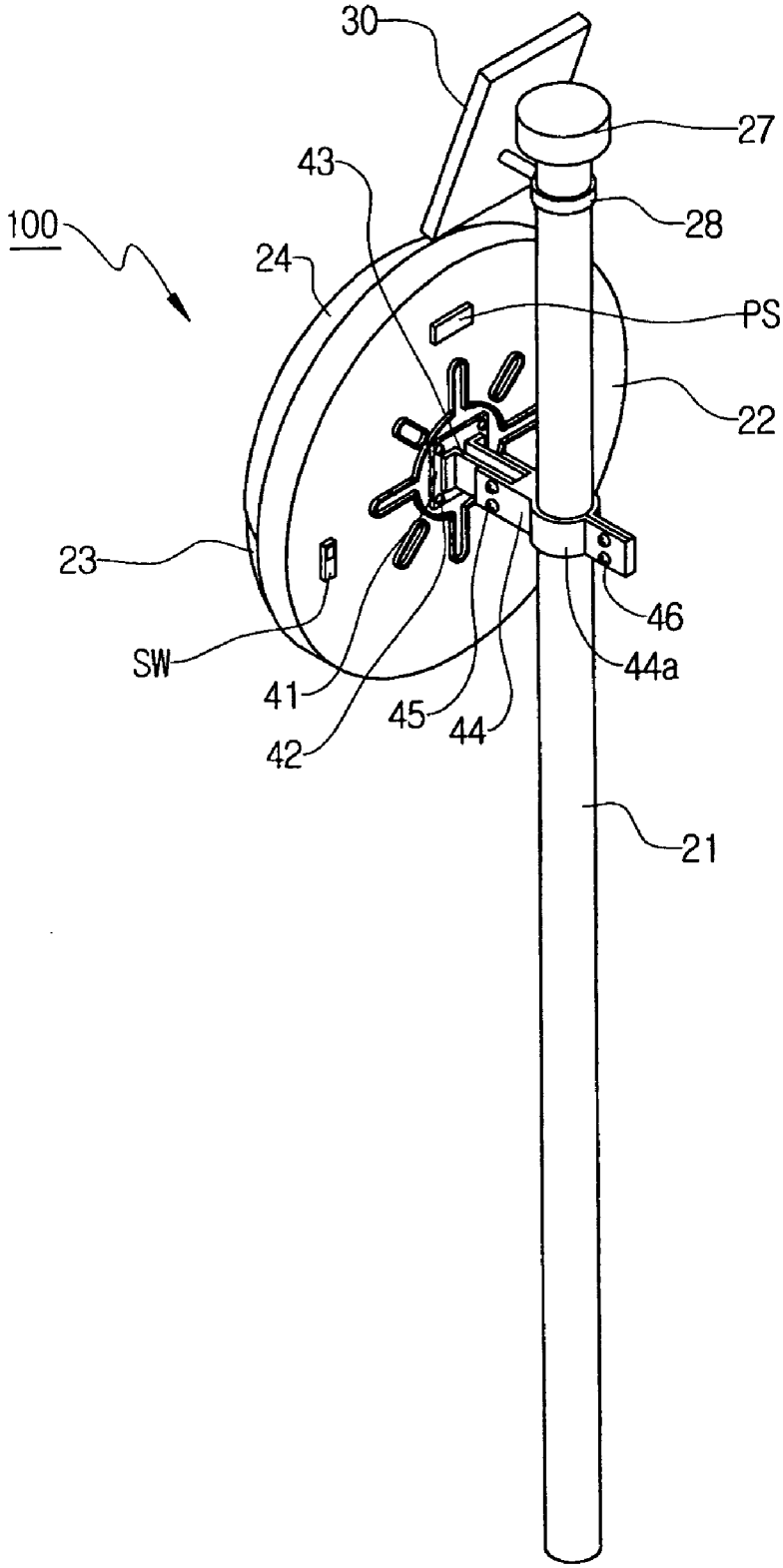
FIG. 3 is a rear perspective view of the half mirror reflector of FIG. 2.

FIG. 2 is a perspective view of a half mirror reflector having an LED road sign according to the present invention. FIG. 3 is a rear perspective view of the half mirror reflector of FIG. 2.

Referring to FIGS. 2 and 3, the half mirror reflector 100 comprises: a convex half mirror 23 fixed to a support plate 22 and made of polycarbonate (PC); a hood 24 attached to the upper part of the support plate 22; first and second brackets 43 and 44 for fixing the support plate 22 to a support rod 21 by bolt/nut assemblies 45 and 46; a cap 27 for covering the top of the support rod 21; and a solar heat solite (hereinafter referred to as "solar battery module") fixed to the upper part of the support rod 21 by a third bracket 28.

As shown in FIG. 3, the half mirror reflector 100 provides a support bracket 41 at the rear of the support plate 22 onto which the half mirror 23 is fixed. The first bracket 43 is fixed to the support bracket 41. Also, one end of the second bracket 44 is fixed to the first bracket 43, while the other end is fixed to the support rod 21, thereby connecting the support plate 22 to the support rod 21. The second bracket 44 has a circular fixing tube 44*a* for embracing and fixing the support rod 21. The second bracket 44 is fixed to the first bracket 43 by the bolt/nut assembly 45 through a first assembling hole (not shown) formed at one side of the circular fixing tube 44*a*. Also, the second bracket 44 is fixed to the support rod 21 by the bolt/nut assembly 46 through a second assembling hole (not shown) formed at the other side of the circular fixing tube 44*a*.

The solar battery module 30 has a photosensor (not shown) which converts light energy into electric energy.

Also, another photosensor PS and a switch SW are provided at the rear of the support plate 22. The photosensor PS senses ambient light and turns on LEDs 51 in the LED road sign 50 (FIG. 4) at night. If the half mirror reflector 100 is installed in a place which is dark even during daytime (for example, in an underground parking lot), the switch SW can control the half mirror reflector 100 to input a DC power to the LEDs 51 in the LED road sign 50 (FIG. 4) for DC operation.

More specifically, when the switch SW is on, the half mirror reflector 100 supplies an AC power (220V) to the LEDs 51 in the LED road sign 50. When the switch SW is off, the half mirror reflector 100 supplies a DC power generated from the solar battery module 30 to the LEDs 51 in the LED road sign 50.

The half mirror 23 is made of transparent polycarbonate (PC) or acryl. The half mirror 23 is about 250 times stronger than general window glass and about 50 times stronger than acryl. Since the half mirror 23 contains a UV protector, it has excellent durability and endurance to withstand external shocks. Also, the half mirror 23 is as light as half of a conventional stainless reflector mirror. The half mirror 23 can be semipermanently used because its surface does not become discolored with time.

Hereinafter, a method for manufacturing the half mirror reflector according to the present invention will be briefly explained.

A half mirror 23 is formed by cutting a polycarbonate plate in predetermined shape (circular or quadrangular) and size and machining the cut plate to have a convex surface that bulges outward at the center thereof. After forming an aluminum thin film on one side of the half mirror 23, a transparent coating is applied on both sides of the half mirror 23.

Accordingly, the half mirror 23 has improved object reflectivity and can prevent any distortion or scratch marks caused by external shocks. Also, the half mirror 23 can have a longer life.

Figure 4:
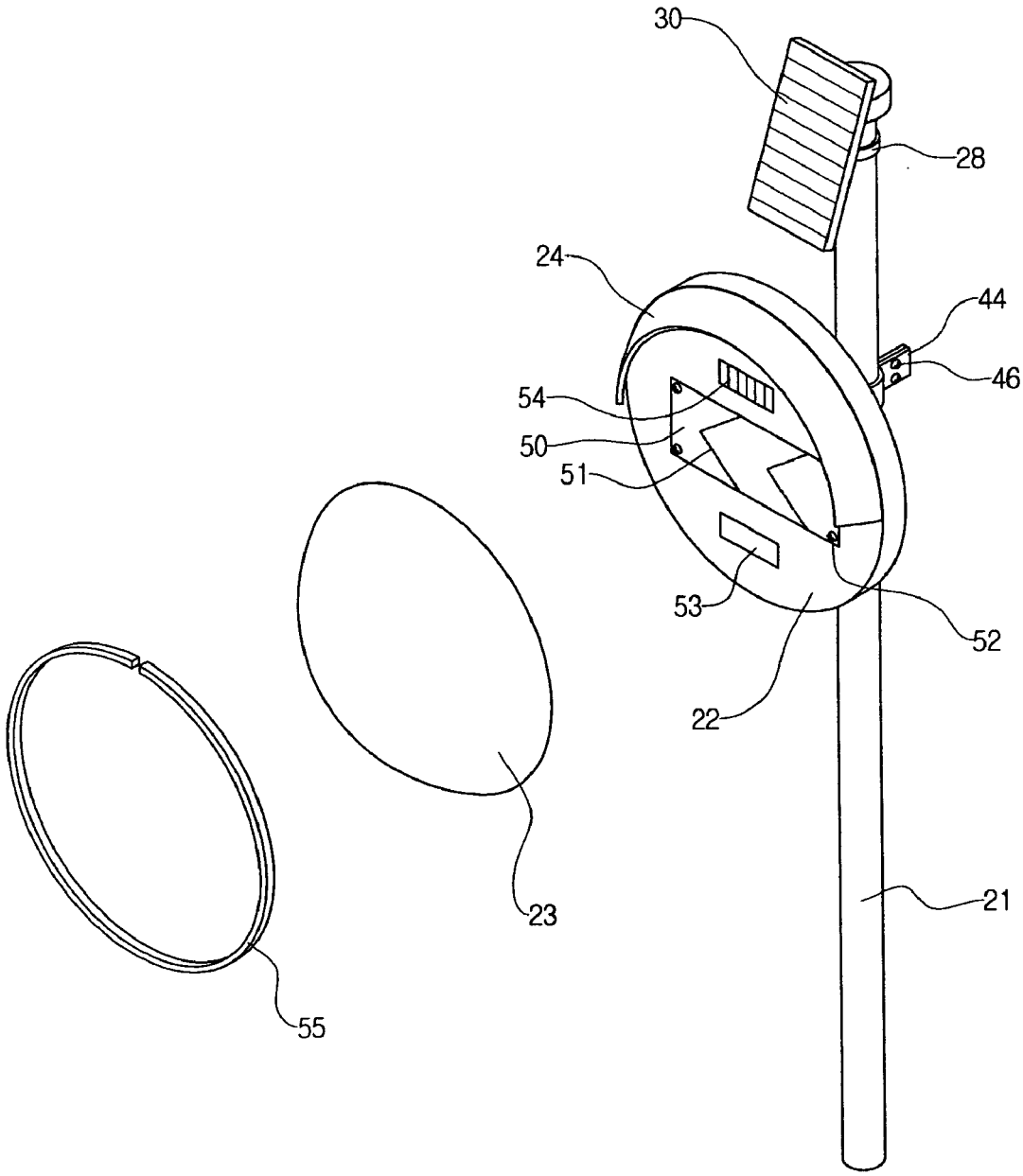
FIG. 4 is an exploded perspective view showing the inside of the half mirror reflector of FIG. 2.

FIG. 4 is an exploded perspective view of the half mirror reflector 100 of FIG. 2.

As shown in FIG. 4, the half mirror reflector 100 includes: a support plate 22 having a hood 24 formed at the upper part thereof; an LED road sign 50 mounted on the support plate 22 and having a plurality of LEDs 51 to indicate a road condition; a PCB substrate 53 mounted on the support plate 22 to operate the LED road sign 50; and a storage battery 54 mounted on the support plate 22 to store electric energy supplied from the solar battery module 30 and supply power to the LED road sign 50 through the PCB substrate 53. A half mirror 23 is tightly fixed to the support plate 22 on which the LED road sign 50, PCB substrate 53 and storage battery 54 are mounted, using a half mirror assembly band 55.

The LED road sign 50 is fastened to the center of the support plate 22 by means of a rivet 52. The hood 24 provided at the upper part of the support plate 22 serves as a rain-screen when it rains.

In FIG. 4, the PCB substrate 53 and the storage battery 54 are illustrated as being positioned respectively at the lower and upper parts of the LED road sign 50 for explanatory convenience. Actually, however, the PCB substrate 53 and the storage battery 54 are placed and sealed at the rear of the LED road sign 50 so that they can be protected from moisture, rainwater or other contaminants.

The solar battery module 30 is a device that converts light energy into electric energy. The energy conversion efficiency of the solar battery module 30 is above 18% for a Si semiconductor and over 28% for a GaAs semiconductor according to the concentration rate (solar collector aperture area/light harvesting surface area). The storage battery 54 supplies constant voltage and current to the LED road sign 50 on cloudy days (days having less amount of light) or at night. The storage battery 54 can be used at a high temperature (for example, 70° C.) or at a low temperature (for example, −40° C.). The storage battery 54 has a sufficiently large capacity (for example, 2,800 mah) to operate the LED road sign 50 for a predetermined period of time (for example, 15 days to 30 days), even without being supplied with power from the solar battery module 30.

Figure 5:
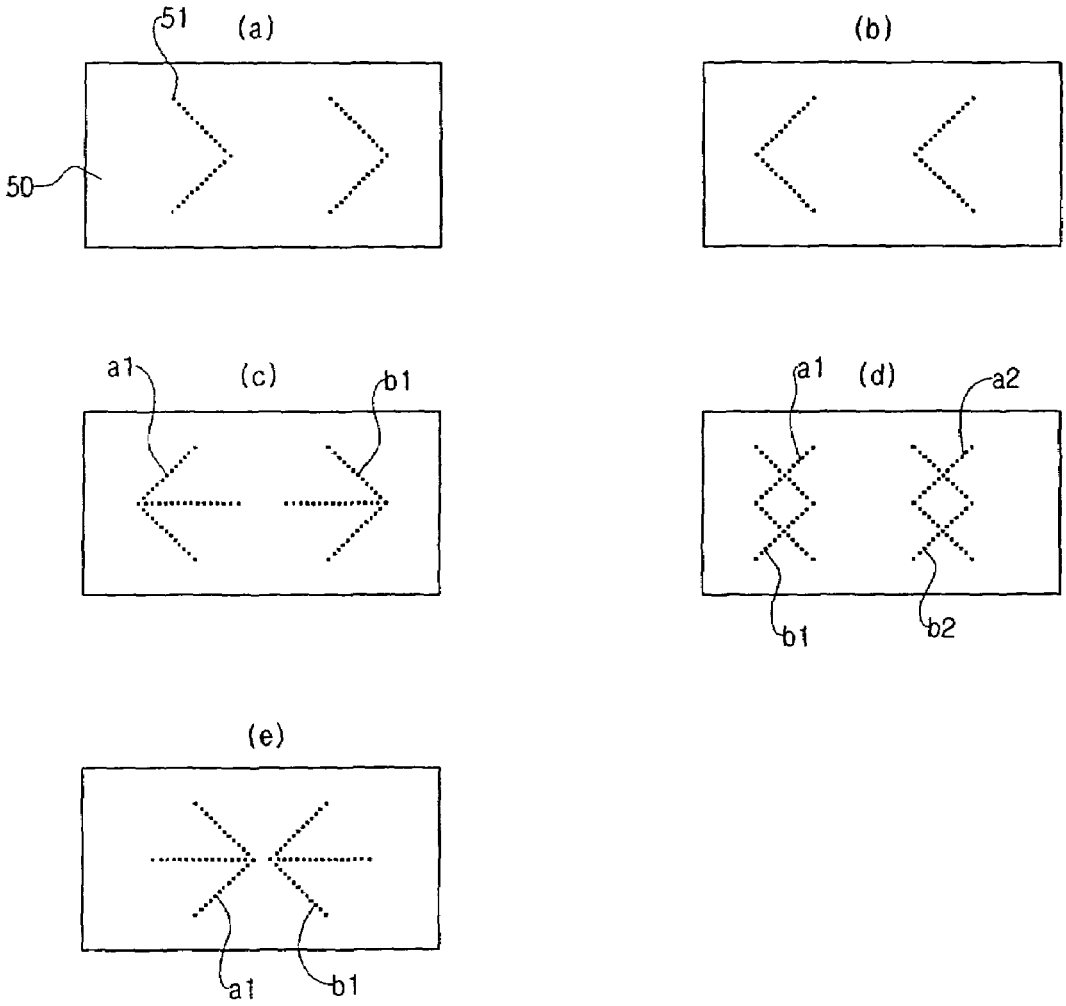
FIG. 5 shows examples of LED road signs according to the present invention.

FIG. 5 shows examples of the LED road sign 50 according to the present invention.

The LED road sign 50 indicates a roadway condition as illustrated in FIG. 5(*a*)–(*e*), using a plurality of LEDs 51. Sign (a) warns drivers of a sharp curve at the right side. Sign (b) warns drivers of a sharp curve at the left side. Sign (c) alerts drivers to move/merge left (a1) or right (b1). Sign (d) warns drivers of a left sharp curve (a1, a2) or a right sharp curve (b1, b2). Sign (e) alerts drivers to move/merge left (a1) or right (b1).

The half mirror reflector 100 having the LED road sign 50 enables drivers to see vehicles approaching in the opposite direction through the half mirror 23 in a curved road. Also, the half mirror reflector 100 turns on the LED road sign 50 placed under the half mirror 23 at night so that drivers can see the LED road sign 50 from a distance and check any curve ahead for safe driving.

Figure 6:
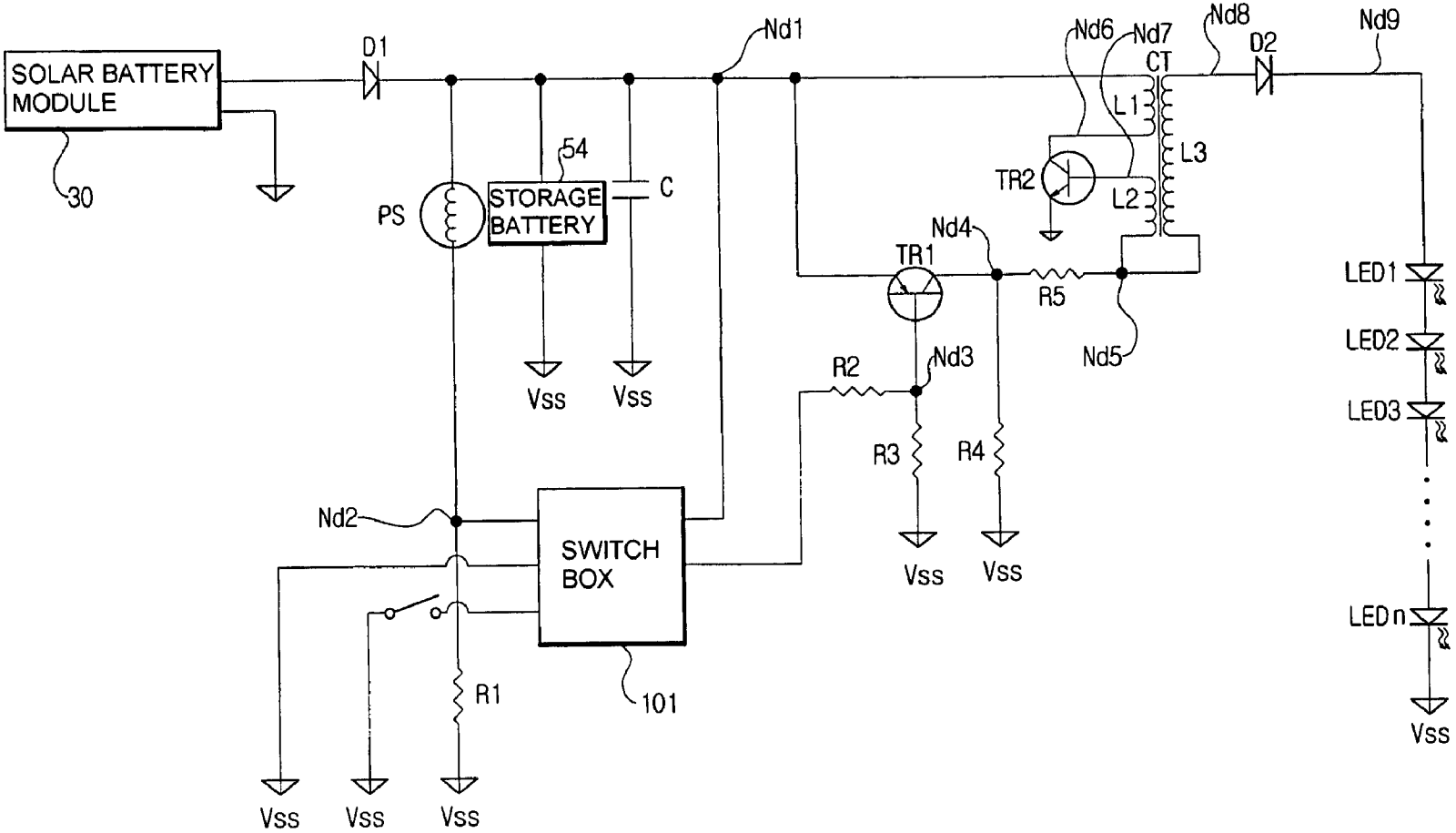
FIG. 6 is a circuit diagram showing a DC voltage related circuit of an LED road sign according to the present invention.

FIG. 6 is a circuit diagram showing a DC voltage related circuit of the LED road sign 50 according to the present invention.

Referring to FIG. 6, the DC voltage circuit of the LED road sign 50 includes: a solar battery module 30 for converting light energy into electric energy (DC voltage); a first diode D1 for rectifying the DC voltage outputted from the solar battery module 30 and outputting the rectified DC voltage to a first node Nd1; a storage battery 54 for storing a current transferred to the first node Nd1; a capacitor C coupled between the first node Nd1 and a ground voltage Vss; a photosensor PS and a first resistor R1 connected in series between the first node Nd1 and a ground voltage Vss; a switch box 101 for receiving power from the first node Nd1, generating a control signal for operating LEDs in the LED road sign 50 using the photosensor or a switch and outputting the control signal to a third node Nd3; a second resistor R2 coupled between an output terminal of the switch box 101 and the third node Nd3; a third resistor R3 coupled between the third node Nd3 and a ground voltage; a PNP bipolar transistor TR1 for switching a voltage of the first node Nd1 to a fourth node Nd4 by a voltage of the third node Nd3; a fourth resistor R4 coupled between the fourth node Nd4 and a ground voltage Vss; a fifth resistor R5 coupled between the fourth node Nd4 and a fifth node Nd5; a first inductor L1 coupled between the first node Nd1 and a sixth node Nd6; a second inductor L2 coupled between the fifth node Nd5 and a seventh node Nd7; an NPN bipolar transistor TR2 for flowing a voltage of the sixth node Nd6 to a ground voltage Vss by a voltage of the seventh node Nd7; a current transformer CT coupled between the fifth node Nd5 and an eighth node Nd8 to convert a first current induced to the first and second inductors L1 and L2 by the NPN bipolar transistor TR2 and generating a second current to be outputted to the eighth node Nd8; a second diode D2 for rectifying the current of the eighth node Nd8 and transferring the rectified current to a ninth node Nd9; and a plurality of LEDs LED 1 to LEDn connected in series between the ninth node Nd9 and a ground voltage Vss.

In the DC voltage related circuit of the LED road sign 50, the switch box 101 is operated by the switch SW or the photosensor PS. The switch box 101 applies a voltage to the third node Nd3, whereby the PNP bipolar transistor TR1 operates to apply the voltage of the first node Nd1 to the seventh node Nd7 through the fifth resistor R5, fifth node Nd5 and second inductor L2. Accordingly, the NPN bipolar transistor TR2 operates to flow a current through the first inductor L1. The current transformer CT consisting of the first to third inductors L1 to L3 generates the second current according to the first current induced to the first and second inductors L1 and L2. The second current generated from the current transformer has a constant current and voltage, and is supplied to the plurality of LEDs LED1 to LEDn in the LED road sign 50 through the second diode D2. If at least one of the LEDs LED1 to LEDn does not properly operate, the problematic LED will be shorted and the other LEDs will normally operate.

Figure 7:
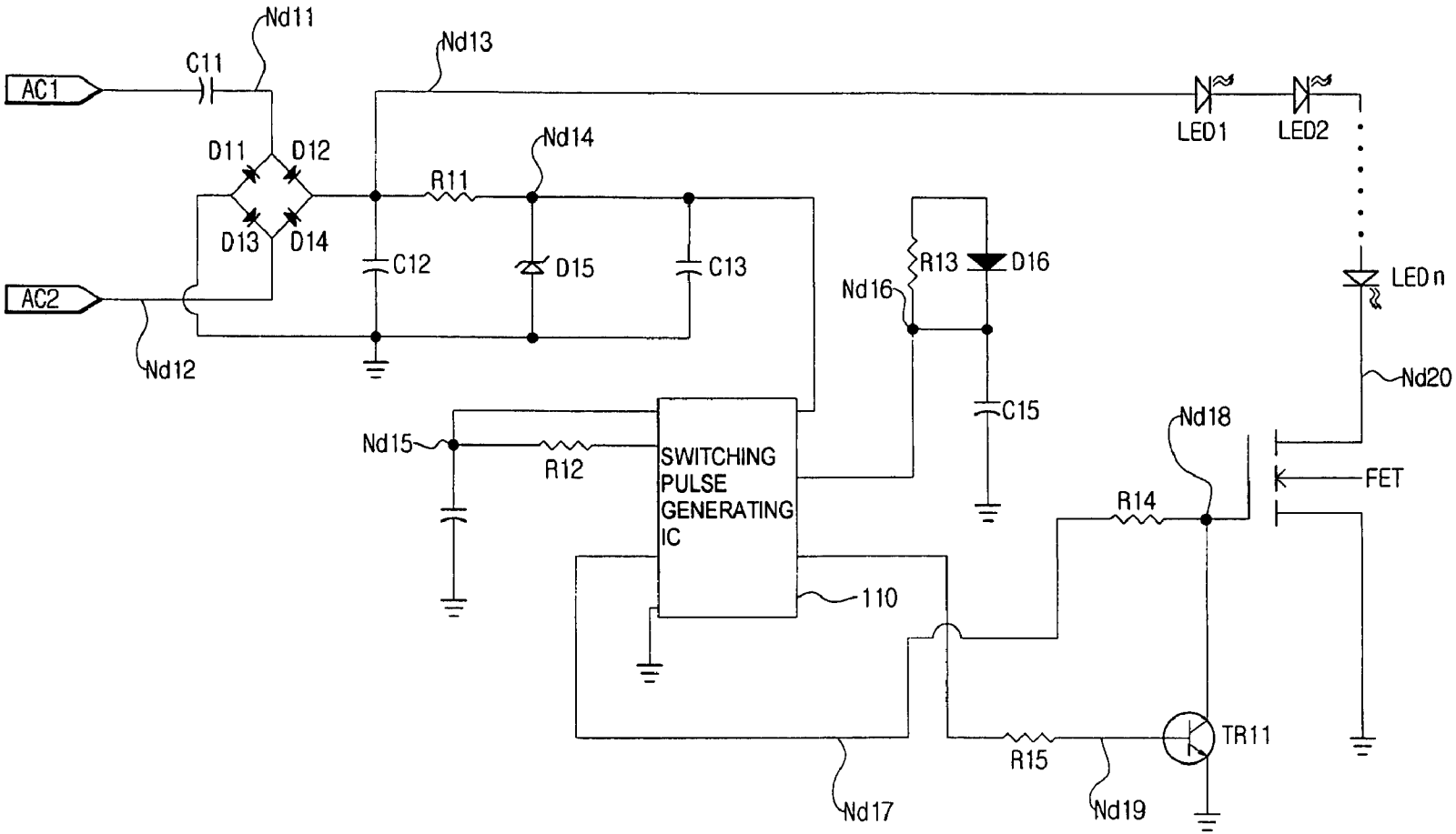
FIG. 7 is a circuit diagram showing an AC voltage related circuit of an LED road sign according to the present invention.

FIG. 7 is a circuit diagram showing an AC voltage related circuit of the LED road sign according to the present invention.

Referring to FIG. 7, the AC voltage related circuit of the LED road sign includes: an eleventh capacitor C11 for limiting the current of a first AC power AC1 and transferring the limited current to an eleventh node Nd11; bridge diodes D11 to D14 for receiving the first AC power AC1 and a second AC power AC2, converting a DC power and outputting the converted DC power to a thirteenth node Nd13; a plurality of LEDs LED1 to LEDn connected in series between the thirteenth node Nd13 and a twentieth node Nd20; an eleventh resistor R11 coupled between the thirteenth node Nd13 and a fourteenth node Nd14; a twelfth capacitor C12 coupled between the thirteenth node Nd13 and a ground voltage Vss; a zener diode D15 coupled between the ground voltage Vss and the fourteenth node Nd14; a thirteenth capacitor C13 coupled between the ground voltage Vss and the fourteenth node Nd14; a switching pulse generating IC 110 for inputting a DC power transferred to the fourteenth node Nd14; a twelfth resistor R12 and a fourteenth capacitor C14 coupled between an input terminal of the switching pulse generating IC 110 and a ground voltage Vss to generate a frequency according to an RC time constant; a thirteenth resistor R13, a sixteenth diode D16 and a fifteenth capacitor C15 coupled between the input terminal of the switching pulse generating IC 110 and a ground voltage Vss to regulate the switching pulse width; a fifteenth resistor R15 coupled between a switching pulse output terminal of the switching pulse generating IC 110 and a nineteenth node Nd19; a fourteenth resistor R14 coupled between the output terminal of the switching pulse generating IC 110 and an eighteenth node Nd18; an NPN bipolar transistor TR11 for switching a voltage of the eighteenth node Nd18 to a ground voltage Vss by the voltage of the nineteenth node Nd19; and an FET switching element for switching a voltage of a twentieth node Nd20 to a ground voltage Vss by the voltage of the eighteenth node Nd18.

In the AC voltage related circuit of the LED road sign 50, when an AC power is applied by the switch SW, the switching pulse generating IC 110 generates a switching pulse signal and outputs the signal to the nineteenth node Nd19 and thereby turns on the NPN bipolar transistor TR11. Accordingly, the FET switching element is turned on to operate the plurality of LEDs LED1 to LEDn.

The half mirror reflector 100 having the LED road sign 50 can be installed in a place which is dark even during daytime (for example, in an underground parking lot). If the switch SW provided at the rear of the support plate 22 is turned on, a DC power will be inputted to operate the LEDs 51 in the LED road sign 50 (FIG. 4). In other words, if the half mirror reflector 100 having the LED road sign 50 is installed in a place where the photosensor PS does not operate, it is possible to operate the LED road sign 50 all day long by turning on the switch SW. The half mirror reflector 100 will then serve as both a road reflector and a LED road sign.

If the half mirror reflector 100 having the LED road sign 50 is installed in a place which is bright during daytime (for example, on a road), the switch SW should be turned off. When it gets dark (on a cloudy day or at night), the half mirror reflector 110 supplies the DC power stored in the storage battery 54 to the LEDs in the LED road sign 50 to turn on and operate the LEDs. The LEDs in the LED road sign 50 are turned off during daytime. The half mirror reflector 100 is used as both a reflector and an LED road sign at night or in the dark, while it is used solely as a reflector in the daytime.

Although a preferred embodiment of the present invention has been described for illustrative purposes, those skilled in the art will appreciate that various modifications, additions and substitutions are possible, without departing from the scope and spirit of the invention as disclosed in the accompanying claims.

As described above, the half mirror reflector having an LED road sign according to the present invention can be used as a reflector in the daytime and as both a reflector and a road sign in the nighttime. If the half mirror reflector is installed in a place which is dark even during daytime (for example, in an underground parking lot), it can input a DC power by turning on a switch SW and operate the LED road sign for 24 hours a day.

The half mirror reflector is made of polycarbonate to improve object reflectivity and endurance against external shocks and prevent its surface from easily being discolored.

The LED road sign provided within the half mirror reflector is driven by a solar battery. Also, the half mirror reflector having the LED road sign converts a current generated by a solar battery to a constant current using a current transformer and supplies the constant current to the LEDs in the LED road sign, thereby ensuring semipermanent use of the LEDs.

What is claimed is:

1. A half mirror reflector comprising:

a support plate attached to a support rod;

a half mirror fixed to the support plate;

an LED road sign mounted on the support plate under the half mirror and having a plurality of LEDs;

a PCB substrate mounted on the support plate under the half mirror to control the operation of the LED road sign; and a solar battery module provided at the upper part of the support rod to generate a voltage for operating the LED road sign and supply the voltage to the PCB substrate.

2. The half mirror reflector according to claim 1, further comprising a storage battery mounted on the support plate under the half mirror to store a voltage supplied from the solar battery module and transfer the stored voltage to the PCB substrate.

3. The half mirror reflector according to claim 1, wherein said half mirror has a convex circular shape.

4. The half mirror reflector according to claim 1, wherein said half mirror is coated with a transparent coating on both sides thereof after having an aluminum thin film formed on one side thereof.

5. The half mirror reflector according to claim 4, wherein said half mirror contains a UV protector.

6. The half mirror reflector according to claim 1 wherein said half mirror is formed from any one of polycarbonate (PC) and acryl.

7. The half mirror reflector according to claim 1, further comprising:

a support bracket fixed to the rear of the support plate;

a first bracket fixed to the support bracket; and a second bracket having one end fixed to the first bracket and the other end fixed to the support rod.

8. The half mirror reflector according to claim 1, further comprising a third bracket for fixing the solar battery module to the upper part of the support rod.

9. The half mirror reflector according to claim 1, wherein said PCB substrate includes:

a first diode for rectifying a direct current generated from the solar battery module and outputting the rectified direct current to a first node;

a storage battery for storing a voltage of the first node;

a photosensor coupled between the first node and a ground voltage to sense ambient light;

a switch box for receiving power from the first node, generating a control signal for operating LEDs in the LED road sign using the photosensor or a switch and outputting the control signal to a third node;

a first transistor for switching the voltage of the first node by a voltage of the third node;

a current transformer for converting a first current supplied from the first node through first and second inductors by the switched voltage from the first transistor and generating a second current to be outputted to a third inductor;

a second transistor for switching a current to flow through the first and second inductors by the switched voltage from the first transistor; and a second diode for rectifying a current outputted from the current transformer and supplying the rectified current to a plurality of LEDs in the LED road sign.

10. The half mirror reflector according to claim 9, wherein said PCB substrate further includes:

a first resistor coupled between the photosensor and a ground voltage;

a second resistor coupled between an output terminal of the switch box and the third node;

a third resistor coupled between the third node and a ground voltage;

a fourth resistor coupled between one end terminal of the first transistor and a ground voltage; and a fifth resistor coupled between one end terminal of the first transistor and one end terminal of the second inductor.

11. The half mirror reflector according to claim 9, wherein said first transistor is a PNP bipolar transistor and said second transistor is an NPN bipolar transistor.

12. The half mirror reflector according to claim 1, wherein said PCB substrate includes:

a bridge diode for converting an AC power into a DC power and outputting the DC power;

a plurality of LEDs and a FET switching element connected in series between an output terminal of the bridge diode and a ground voltage;

a switching pulse generating IC for receiving the DC power outputted from the bridge diode and generating a switching pulse signal; and a transistor for driving the FET switching element according to the switching pulse signal.

13. The half mirror reflector according to claim 12, wherein said PCB substrate further includes:

a protective resistor coupled between an output terminal of the bridge diode and an input terminal of the switching pulse generating IC; and a zener diode for maintaining a constant DC voltage to be inputted to the switching pulse generating IC.

14. The half mirror reflector according to claim 12, wherein said switching pulse generating IC includes:

a frequency generator for generating a frequency according to an RC time constant; and a pulse width controller for controlling a pulse width of a switching pulse.

15. The half mirror reflector according to claim 12, wherein said transistor is an NPN bipolar transistor.

* * * * *